US005540261A

United States Patent [19]

McGinley

[11] Patent Number: 5,540,261

[45] Date of Patent: Jul. 30, 1996

[54] WARP WAVE WEAVING METHOD AND APPARATUS WITH PNEUMATIC WEFT INSERTION

[76] Inventor: Thomas F. McGinley, 2941 Woods Hollow La., Allentown, Pa. 18103

[21] Appl. No.: 539,782

[22] Filed: Oct. 5, 1995

[51] Int. Cl.[6] ..... D03D 47/00

[52] U.S. Cl. ..... 139/11; 139/28; 139/435.3; 139/450

[58] Field of Search ..... 139/11, 28, 435.3, 139/450

[56] References Cited

U.S. PATENT DOCUMENTS

| | | | |
|---|---|---|---|
| 4,122,871 | 10/1978 | McGinley | 139/11 |
| 4,122,872 | 10/1978 | McGinley | 139/11 |
| 4,285,370 | 8/1981 | McGinley | 139/11 |
| 4,351,367 | 9/1982 | McGinley | 139/11 |
| 4,425,946 | 1/1984 | McGinley | 139/11 |
| 4,887,650 | 12/1989 | McGinley | 139/460 |
| 4,907,627 | 3/1990 | McGinley | 139/11 |
| 5,146,955 | 9/1992 | Steiner et al. | 139/28 |
| 5,417,250 | 5/1995 | Markey | 139/435.3 |

*Primary Examiner*—Andy Falik
*Attorney, Agent, or Firm*—Richard E. Jenkins, P.A.

[57] ABSTRACT

A method and apparatus for multi-shed warp-wave weaving wherein weft threads are inserted into shed retainers by a stationary weft thread supply chamber. The inserted weft thread is transported through the shed retainer by air jet nozzles cooperatively associated with the shed retainer and in fluid communication with corresponding air supply sources stationarily mounted beneath the pathway of the shed retainers from weft thread insertion towards the fell of the fabric being woven. The weft thread inserting mechanism in combination with the air supply system act to increase the efficiency and reliability of weft insertion in multi-shed warp-wave weaving.

12 Claims, 8 Drawing Sheets

WARP WAVE WEAVING METHOD AND APPARATUS WITH PNEUMATIC WEFT INSERTION

TECHNICAL FIELD

The present invention relates to a method and apparatus for weaving, and more particularly to an improved method and apparatus for multi-shed warp-wave weaving using an improved weft insertion system.

BACKGROUND OF THE INVENTION

Until recently, there have been only two basic types of multi-shed weaving systems. One system is the flat weft-wave weaving system wherein a multiplicity of sheds move in the weft direction along a flat path. The second system is the curved warp-wave or rotor system in which a multiplicity of sheds move in the warp direction along a curved path. As is well known to those skilled in the art, both of these weaving systems suffer from several disadvantages, one of the most critical disadvantages being the severe limitation in the diversification of weaves available due to the inability to use standard shed-forming mechanisms.

There is disclosed a third type of multi-shed weaving in applicant's own U.S. Pat. No. 4,122,871 which overcomes many of the disadvantages of the flat weft-wave systems and the curved warp-wave systems. This new and improved multi-shed weaving technique involves the use of flat warp-wave systems (i.e., those in which a multiplicity of sheds move in the warp direction along a substantially flat path). This third type of weaving is advantageous due to its versatility in weaving different patterns while still providing the productivity of multi-shed weft insertion.

In a multi-shed warp-wave loom utilizing applicant's previously disclosed warp-wave weaving system, multiple shed retainers are employed which sustain multiple sheds traveling in a wave-like form in a direction parallel with the warp threads towards the fell of the cloth. Each of the sheds receives a weft thread, which is preferably inserted by an air jet. A separate shed forming apparatus is provided for forming the warp sheds by elevating and lowering selected warp threads in a conventional manner.

The multi-shed weaving systems utilize the fluid jet, usually air, to insert the weft thread through the open sheds, and the fluid, along with the weft thread, are directed through a weft guide channel and shed retainer positioned within the open warp shed. The weft guiding channel is necessary to direct the jet of air within the open shed, and to maintain the speed of the jet at the velocity required for transporting the weft thread completely through the open shed while preventing (1) the jet from interfering with the warp threads forming the open shed and (2) the warp sheds from interfering with the insertion of the weft. Reference is now made to applicant's own U.S. Pat. No. 4,425,946 for a complete and detailed description of such multi-shed weaving systems utilizing a fluid jet, preferably air jet, for weft insertion in a multi-shed warp-wave loom.

As can be appreciated with reference to the multi-shed warp-wave apparatus and method disclosed in applicant's U.S. Pat. No. 4,425,946, a complicated structure is provided for maintaining alignment of the main air nozzles with the moving shed retainers. Specifically, at column 10, there is disclosed a weft insertion mechanism including a plurality of air jets associated with the shed retainers and which are caused to move with the shed retainers in a synchronized movement by a control mechanism utilizing a plurality of manipulating arms secured to the corresponding plurality of air jets. This multiple air jet weft insertion system has been found to be complex and unwieldy in use.

Also, U.S. Pat. No. 4,425,946 generally discloses, at columns 13–14, an air nozzle relay system to assist in transporting an inserted weft yarn through the channel (or tube) defined by a plurality of the shed-retaining members of the shed retainer. As best seen in FIGS. 31–33 of the drawings, the patent discloses providing compressed air to a valve which slidably receives one end of a hollow stem of a shed retaining member therein. Compressed air is supplied to the interior of the valve through a port which normally does not fluidly communicate with a port in the stem of the shed retaining member unless a cam surface urges the valve upwardly against the force of coil springs until the ports communicate and compressed air flows through the stem of the shed retaining member to the passageway of the channel defined by the plurality of shed retaining members. In this fashion, the compressed air delivered to the channel facilitates the insertion of a weft thread initially inserted by an air jet through the entirety of the length of the channel. The air nozzle relay system generally described in applicant's U.S. Pat. No. 4,425,946 also has been found to be complex and impractical in use.

Thus, applicant has now developed an improved weft insertion mechanism and air nozzle relay mechanism that simplifies and yet vastly improves the functionality of applicant's multi-shed warp-wave weaving method and apparatus as previously best described in applicant's own U.S. Pat. No. 4,425,946.

SUMMARY OF THE INVENTION

The present invention relates generally to a multi-shed warp-wave method and apparatus of the general type described in applicant's U.S. Pat. No. 4,425,946. In particular, the present invention provides a multi-shed warp-wave weaving apparatus having an improved weft insertion system comprising shed retaining means that retain the sheds by inserting a plurality of shed retaining members into each of the sheds such that the plurality of shed retaining members form a plurality of substantially closed tubes wherein each tube is formed in a corresponding one of said retained sheds. Weft inserting means is utilized comprising a weft thread supply chamber with a plurality of weft threads therein and that is stationarily mounted adjacent the pathway of movement of said shed retaining means towards the fell of a fabric being woven, and that is adapted to pneumatically insert the weft threads into the tubes formed by the shed retaining means as the tubes pass thereby such that each weft thread is substantially constrained within a corresponding one of the tubes by associated shed retaining members until its respective retained shed is released. The weft inserting means further comprises an air supply means that is stationarily mounted beneath the shed retaining means and adapted to fluidly communicate with each of the tubes and to provide an air flow in the weft thread insertion direction during the continuous movement of the tubes towards the fell of a fabric being woven such that each of the weft threads inserted within a corresponding one of the tubes by the weft thread supply chamber is caused to traverse the tube before its respective retained shed is released.

In addition, the multi-shed warp-wave weaving method provides an improvement to the weft insertion process comprising providing a weft thread supply chamber with a plurality of weft threads therein, stationarily mounted adjacent the pathway of movement of the shed retaining means towards the fell of a fabric being woven, and pneumatically inserting the weft threads into the tubes formed by the shed retaining means as the tubes pass the weft thread supply chamber and wherein each weft thread is substantially constrained within a corresponding one of the tubes by an associated shed retaining means until its respective retained shed is released. The weft threads are then caused to traverse the tubes by providing an air flow therein in the direction of insertion of the weft threads with an air supply means stationarily mounted beneath the shed retaining means and fluidly communicating with each of the tubes during the continuous movement of the tubes towards the fell of a fabric being woven such that each of the weft threads inserted within a corresponding one of the tubes by the weft supply chamber is caused to traverse the tube before its respective retained shed is released.

It is therefore the object of the present invention to provide an improved weft insertion system for a multi-shed warp-wave weaving system to simplify and improve the reliability of weft insertion into the plurality of retained sheds continuously being formed and moving toward the fell of the fabric being woven.

It is another object of the present invention to provide an improved weft insertion system for a multi-shed warp-wave weaving system that provides increased productivity due to the enhanced weft velocity imparted by the main nozzle and relay nozzles in the shed retainers to a weft yarn inserted therein at a first velocity by the stationary thread supply chamber.

It is another object of the present invention that provides continuous and perfect fixed alignment of the main nozzles and their corresponding tubes for each shed retaining station.

Some of the objects of the invention having been stated, other objects will become evident as the description proceeds, when taken in connection with the accompanying drawings described hereinbelow.

DETAILED DISCUSSION OF PREFERRED EMBODIMENT OF THE INVENTION

Warp-Weave Loom State of the Art

The present invention is especially suited for use in connection with a flat multi-phased or multi-shed weaving loom which utilizes multiple sheds traveling in a wave-like manner in a direction parallel to the warp threads. In this regard, reference is made to applicant's own U.S. Pat. No. 4,425,946 for a complete and detailed description of such a multi-shed warp-wave weaving loom and its operation, including a prior art weft insertion and air supply system for inserting weft yarn and transporting the inserted weft yarn through the shed retainer means.

Figure 7:
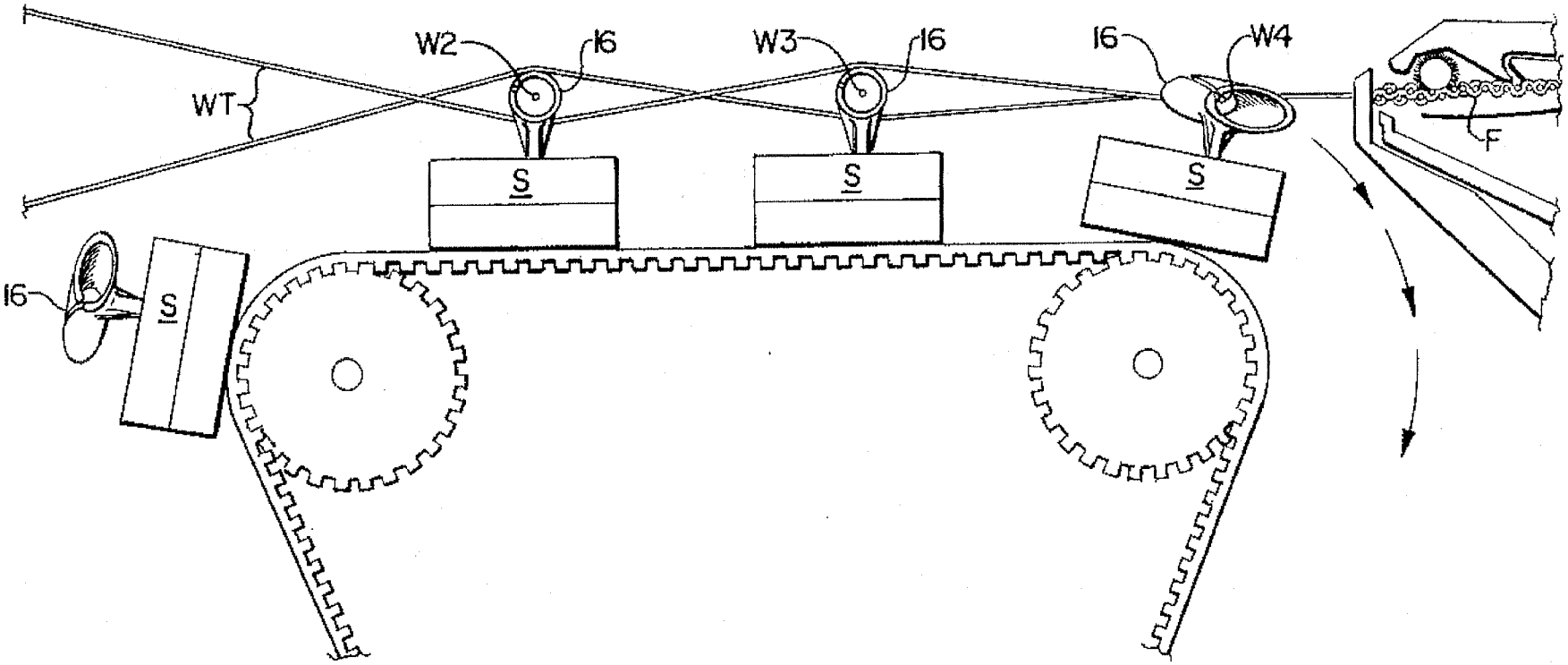
FIG. 7 is a schematic side elevational view of the shed retaining means for retaining a plurality of sheds during the continuous movement of the sheds from a first location on a loom toward a second location spaced a distance from the first location and adjacent the fell of a fabric being formed.

Referring now to the prior art patent disclosure for a better background understanding to appreciate the present invention, the patent provides for a full description of the details of the prior art multi-shed warp-wave weaving system, including the weft insertion and air supply systems used thereby. The prior art weaving loom comprises several weft guide and shed retaining stations, and the weft guide and shed retainer elements disposed at the stations may also be referred to as weft guides or shed retainers in the ensuing description. Each of the shed retaining stations is mounted for movement on a conveyor system including a conveyor driven by sprockets in a clockwise (see FIG. 7) direction, and an additional sprocket is provided for tensioning the conveyor. Heddles are provided for forming an initial shed between the warp threads, and a beat-up mechanism is provided for beating up the weft thread into the fell of the fabric following release of the warp threads by the shed retaining elements and removal of the retainers from the warp. Optional weft advance arms may be provided on the shed retaining stations.

Referring to a shed retaining station, the shed retainer members are preferably elongated oviod in shape and are partially turned, prior to and during their insertion into an open shed, so that the longer axis of the shed retainer members extend substantially parallel to the warp threads while the shed retainer members are being inserted and removed from the shed. The shed retainer members can best be envisioned as diagonal slices of a tube through which a weft yarn will be inserted.

A support stem is attached to the lower portion of the shed retainer members connecting them with each shed retaining station, and each stem supports the tubular section of the shed retainer member for rotation between two positions. In a first position, the tubular section of the shed retainer member is turned so that its narrow dimension or axis lies substantially parallel to the warp threads and warp receiving openings are provided between the shed retainer members. This facilitates insertion and exit of the shed retainer members into and out of the formed sheds of warp threads.

Following insertion of the shed retainer members into the shed the retainer members are turned to their second position at their shed retaining station where they are in their shed guiding and retaining position. In this position, the longer dimension or axis extends generally in the weft direction, and a virtual circular tube is presented for weft insertion. As each of the shed retainer members are moved forwardly by the conveyor toward the fell of the fabric being woven, and as the heddles form the next shed, the upper surface of the tubular section of the shed retainer members engages the upper warp threads, and the lower surface engages the lower warp threads, thereby retaining each shed and moving it toward the fell.

As will be described in more detail below, in the second or warp thread engaging position, the downstream end (relative to the stream of insertion fluid) of each shed retainer members is adapted to abut the upstream of the next adjacent downstream shed retainer member. Moreover, with their respective ends in mutual contact, the bores of the shed retainer members cooperate to form a continuous, substantially closed weft guide or tube through which the weft thread can be inserted by a fluid jet. The force of the insertion fluid jet transports the weft thread through the continuous bore and thereby inserts the weft thread in the shed retained by the shed retainer members. Optionally, relay nozzles may be provided in fluid communication with the continuous bore to assist in transporting the weft thread therethrough.

The shed retainer members are maintained in their warp thread engaging positions as they travel across the top of the conveying system until a desired point is reached near the fell of the cloth (i.e., when the weft thread is fully inserted). At this point, the shed retainer members are actuated via their stems by means within the respective shed retaining stations (for example, in accordance with U.S. Pat. No. 4,425,946) to rotate back to their first or warp thread disengaging position, to disengage the warp threads from the upper and lower surfaces, respectively, and to release the inserted weft thread.

As each of the shed retainer members is turned from its warp thread engaging position to its warp thread disengaging position, the downstream end of each tubular section of each of the shed retaining members is spaced from the upstream end of the next adjacent downstream tubular section of shed retaining member. When each of the shed retainer members are in their warp thread disengaging position, the weft thread exit slots therein are substantially aligned with the weft thread permitting release of the weft thread into the closing shed, with the shed retainer members located in a position which facilitates withdrawal of the shed retainer members from between the warp threads. The beat-up of the weft thread, which has been inserted into the warp shed, occurs following release of the weft thread from the shed retainer member bores, for example by a beat-up mechanism of the type disclosed in applicant's own U.S. Pat. No. 4,425,946 and U.S. Pat. No. 4,887,650.

Weft Insertion Mechanism State of the Art

Applicant's prior art multi-shed warp-wave weaving loom as disclosed in U.S. Pat. No. 4,425,946 and best shown in FIGS. 18–24 of the patent utilizes a complex weft insertion mechanism comprising a plurality of air nozzles that are movingly associated with a plurality of corresponding shed retainers during the weft insertion portion of the weaving cycle. More specifically, the air nozzles of the weft insertion mechanism are connected to respective compressed air hoses and are each adapted to engage the end of a respective shed retaining tube and move conjointly therewith during weft insertion. The plurality of air jets having compressed air hoses secured thereto are carried by a plurality of arms so as to cause the air jets to move in a closed path conjointly with the shed retaining tubes during the insertion of weft threads into the shed retaining tubes. The control mechanisms of U.S. Pat. No. 4,425,946 for controlling the movement of the arms motivating the air nozzles are similar to the control mechanisms also disclosed in applicant's earlier U.S. Pat. No. 4,122,872. A fixed vacuum head on the opposing side of the loom assists the plurality of air nozzles in the insertion of the corresponding plurality of weft threads into the shed retaining tubes during their movement toward the fell of the fabric being woven.

As can be appreciated by one skilled in the art, the hereinbefore described weft insertion system is very complex in construction and would present many practical difficulties in use during high speed multi-shed warp-wave weaving as taught by applicant's prior patents.

Air Jet Relay System State of the Art

Also, applicant's U.S. Pat. No. 4,425,946 generally discloses (see FIGS. 31–33) an air jet relay system to facilitate transportation of weft threads inserted into corresponding shed retaining tubes therethrough and across the width of the warp yarn shed. More specifically, the prior art air jet relay system comprises the use of one or more shed retainer members in a shed retainer tube wherein the shed retaining member contains a passageway extending downwardly through the stem thereof. The end of the hollow stem is slidably received within a valve fluidly connected to a compressed air source. Both the shed retainer stem and the valve have ports which are normally not in fluid communication and thereby prohibit the flow of compressed air from the valve into the passageway of the shed retaining stem. In order to selectively bring the ports into fluid communication, a cam surface is provided to urge followers attached to the valve upward at a predetermined time against the force of coil springs until the ports are in fluid communication and compressed air flows through the stem passageway of the shed retainer member and into the bore defined by the associated plurality of shed retaining members.

The compressed air delivered to the bore is directed along a channel at the bottom thereof so as to facilitate the insertion of a weft thread through the bore. The cam actuated air nozzle relay system disclosed in U.S. Pat. No. 4,425,946 would be quite complex in construction and impractical during high speed weaving operation of a multi-shed warp-wave weaving loom.

Therefore, although applicant's prior art patents (especially U.S. Pat. No. 4,425,946) disclose a remarkable advancement in the art of multi-shed warp-wave weaving, the weft insertion mechanism and air nozzle relay system contemplated thereby and described in U.S. Pat. No. 4,425,946 have been determined to be unusually complex in construction and impractical in use during high speed operation of a multi-shed warp-wave weaving machine. Applicant has now discovered an improved multi-shed warp-wave weaving method and apparatus which utilizes a novel weft insertion mechanism and novel air nozzle relay system that overcome the shortcomings of the prior art. The novel improvements to applicant's multi-shed warp-wave weaving system are described in detail hereinbelow.

Novel Weft Insertion Mechanism

Referring now to FIGS. 1–8 of the drawings, the novel weft insertion mechanism of applicant's invention is shown. More particularly, with reference particularly to FIGS. 1–4 and 8, applicant's novel weft insertion mechanism is shown and generally designated 10. Unlike the prior art weft insertion mechanism that provides unduly complicated apparatus for obtaining simultaneous motion of the air nozzles with the moving shed retainers, weft insertion mechanism 10 comprises weft thread supply chamber 12 which is stationarily mounted on the loom (not shown) and carries a plurality of weft threads therein (e.g., four in the drawings). Weft thread supply chamber 12 is cone-shaped and include four weft threads being fed thereto from conventional weft thread packages or yarn cones C1–C4 that pay out weft threads W1–W4 through conventional weft strand take-up mechanisms T1–T4 to weft thread supply chamber 12. Weft threads W1–W4 are introduced into weft thread supply chamber 12 by means of corresponding guide tubes 12A which each have a corresponding air jet or air supply nozzle 12B fluidly communicating therewith to propel weft yarns W1–W4 through the tapered end of weft thread supply chamber 12 and outwardly therefrom during insertion of the weft threads into the plurality of shed retainers passing thereby in their movement toward the fell of fabric F.

Thus, shed retainer stations S move in a conventional manner (see also FIG. 7) in a horizontal pathway toward the fell of fabric F in order that the shed retainers carried thereby will simultaneously carry a plurality of weft threads toward the fell of fabric F. A fixed main nozzle 14 is mounted on each shed retainer station S so as to traverse the end of weft thread supply chamber 12 in order to pull a corresponding weft thread to be inserted therethrough to initiate its journey through the shed retainer members 16 that act to define a bore across the width of the multi-shed warp-wave loom as disclosed in applicant's previously issued U.S. Pat. No. 4,425,946. Since main nozzles 14 are rigidly affixed to shed retainers S there is assured a constant perfect alignment with the weft shed retainer tube when main nozzles 14 are carried by the end thereof by movement of shed retaining stations S toward the fell of fabric F.

In this manner, the air supply nozzle will be selectively actuated by a control means (not shown) in order to introduce one of weft threads W1–W4 into each main nozzle 14 of a corresponding shed retaining station S during the continuous movement of shed retaining stations S toward the fell of fabric F during operation of the multi-shed warp-wave weaving loom. The insertion of weft threads W1–W4 into main nozzles 14 of shed retaining stations S is further facilitated by four auxiliary air supply nozzles 12C positioned within weft thread supply chamber 12 between guide tubes 12A and the distal tapered end of weft thread supply chamber 12 (see FIGS. 2 and 8).

Thus weft thread supply chamber 12 of the novel weft insertion mechanism of the present invention acts to successively insert weft threads W1–W4 into main nozzles 14 of shed retainer stations S as each nozzle passes the open end of chamber 12. Weft thread supply chamber 12 contains a lateral slot 12D (see FIGS. 4 and 8) which permits each weft thread W1–W4 to successively exit chamber 12 and follow the path of its corresponding main nozzle 14 and the associated tube or bore formed by shed retaining members 16 during insertion of a weft thread. Operation of each main nozzle 14 is begun just prior to reaching the position for threading with weft yarn W1–W4 by chamber 12 so that a vacuum is created at the funnel-shaped entrance to nozzle 14 that will assist the air flow from nozzles 12B and 12C inside chamber 12 in obtaining the required threading of each main nozzle 14 by a corresponding weft thread W1–W4.

Figure 1:
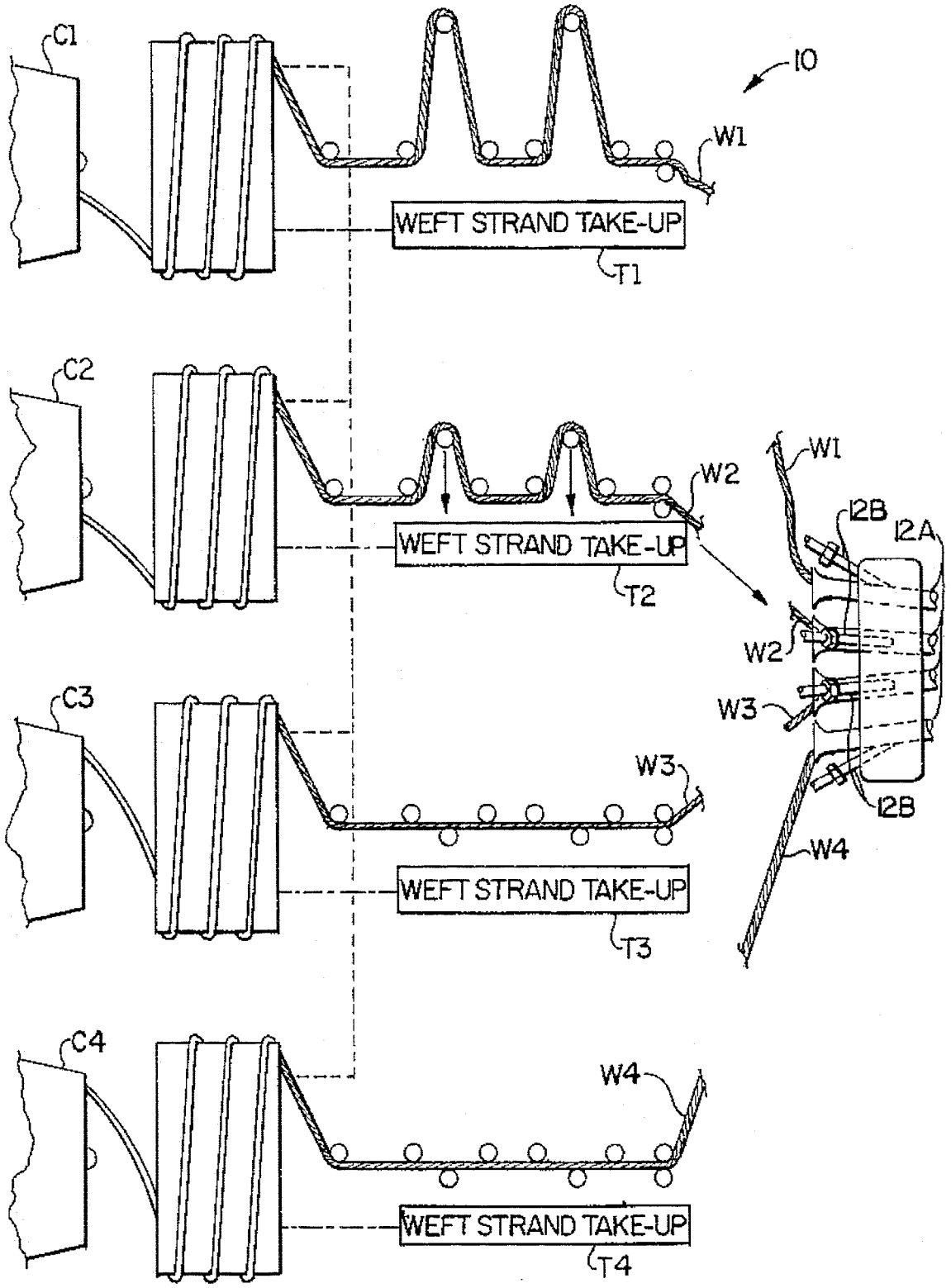
FIG. 1 is a schematic view of the plurality of weft yarns leading to the stationarily mounted weft thread supply chamber.
Figure 2:
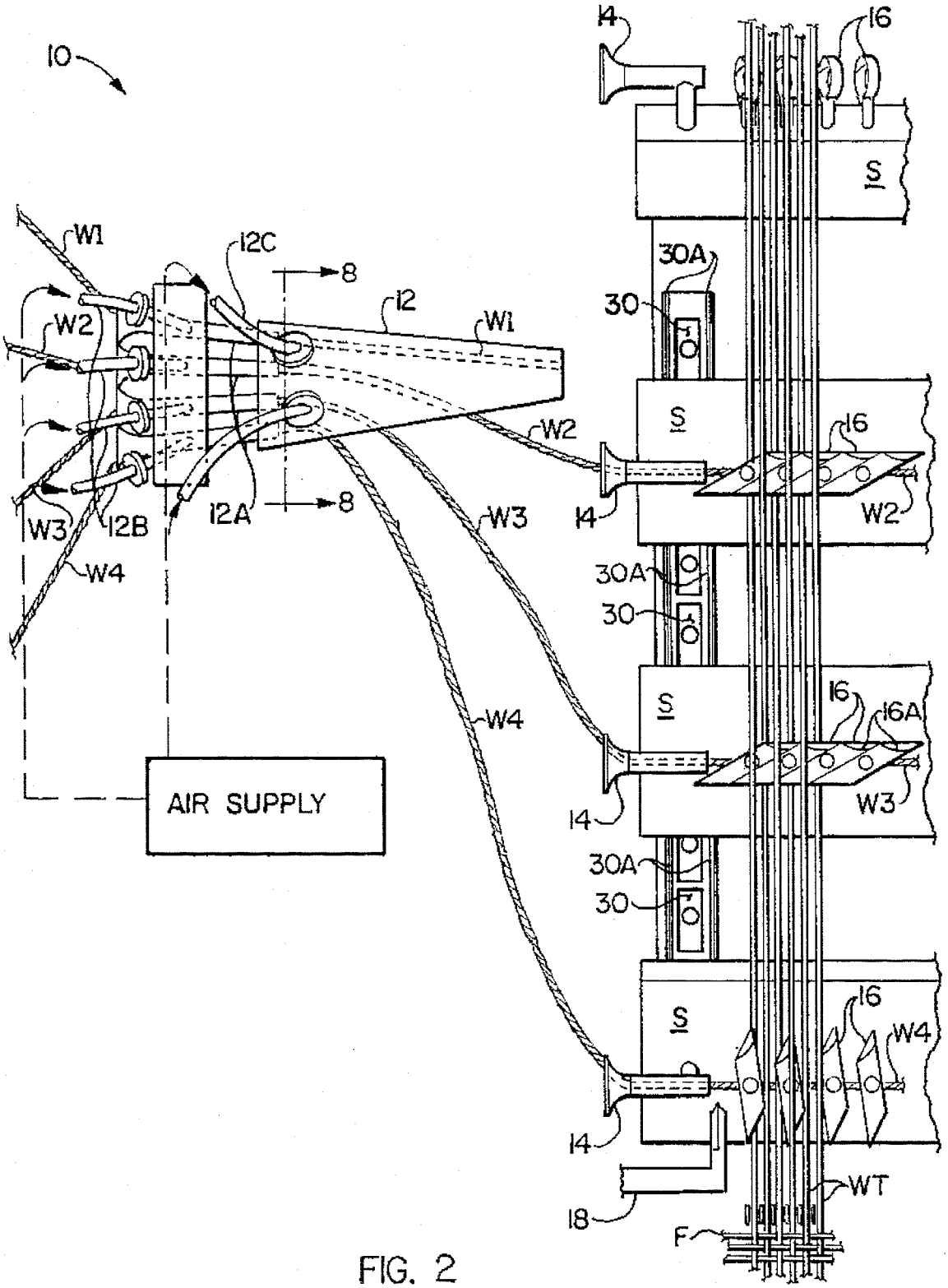
FIG. 2 is a schematic top plan view of the stationarily mounted weft thread supply chamber and the associated air supply source for providing compressed air to the main nozzles of each shed retaining means.
Figure 3:
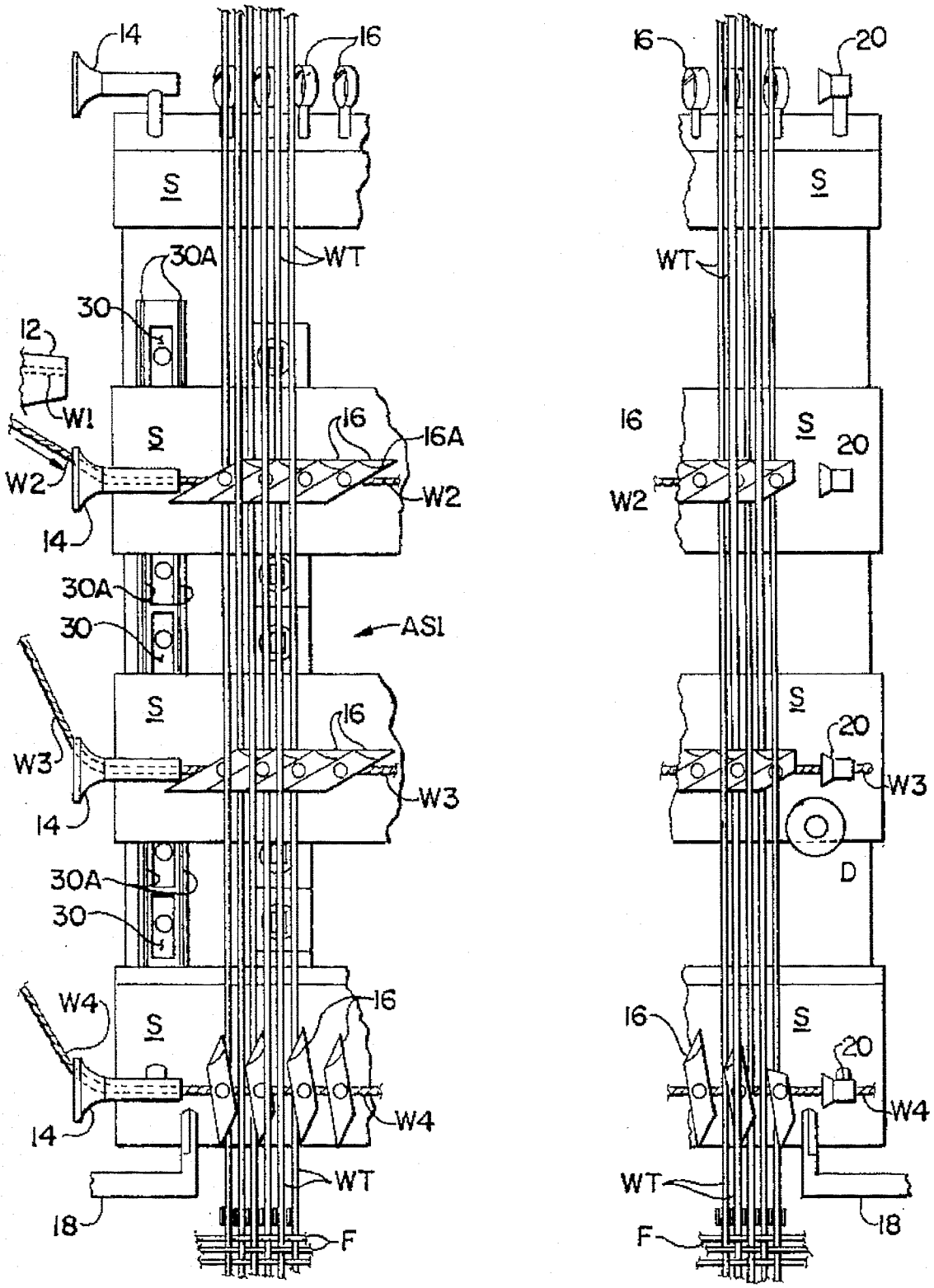
FIG. 3 is a schematic top plan view of the air supply source for providing compressed air to the main air nozzle, a relay air nozzle and the weft tensioning air nozzle of each shed retaining means.

In the embodiment of the invention described herein, four weft threads W1–W4 are required for each weft color desired in woven fabric F in order to permit a weft thread W1–W4 to be always positioned for threading into a main nozzle 14 as main nozzles 14 move past the threading location wherein the bore of chamber 12 and main nozzles 14 are in co-axial alignment. As shown in FIGS. 2 and 3, weft thread W1 is positioned ready to be threaded or inserted into approaching main nozzle 14. Weft threads W2 and W3 are being simultaneously inserted through associated nozzles 14 and the associated bores defined by shed retaining members 16 as the two bores or tubes corresponding to weft threads W2 and W3 move forwardly in a horizontal planar pathway toward the fell of fabric F.

Fourth weft thread W4 has moved forwardly with its corresponding shed retaining station S and shed retainer members 16 and shed retainer members 16 have pivoted open so that as warp threads W2 contact it from above and below it is forced through the slots 16A defined within open shed retainer members 16 as the pivoted members arc downwardly out of the plane of the warp threads. Slots 16A within shed retainer members 16 allow weft thread W4 to exit shed retainer members 16, and it is clamped and cut at each end by clamping scissors 18 (see FIGS. 2 and 3) so as to allow the supply end of weft thread W4 to be withdrawn from main nozzle 14 of shed retainer station S and the excess length of weft thread W4 to be vacuumed away at the distal side of the loom (not shown). As will be described in detail hereinbelow, a tensioning nozzle 20 fixedly mounted to each shed retainer station S at the end remote from main nozzle 14 holds inserted weft threads W3 and W4 for detection by weft detector D and clamping and cutting by scissors 18 prior to beating up of the weft thread into the fell of fabric F.

Weft detector D (see FIGS. 3 and 5) may be any type of known photo-optical or related type of device used by those skilled in the art to detect the presence or absence of a weft thread beneath the fixed location of detector D. Should detector D fail to detect a weft thread at its weft detection fixed position, the multi-shed warp-wave loom (not shown) will be caused to stop with the indicated bore or tube formed by shed retainer members 16 at a location prior to rotation and opening of shed retainer members 16 so that a replacement weft thread (not shown) can be inserted. The weft insertion nozzles associated with the bores or tubes formed by shed retainer members 16 can be separately supplied with compressed air and controlled at this location in order to allow for operator or automatic insertion of a repair weft thread when the loom stops due to detector D sensing a missing weft thread. A detailed description of the main nozzle, relay nozzle(s) and tension nozzle of shed retaining stations S and their fluidly associated air supply means (novel air jet relay system) will be described in detail hereinbelow and provides applicant's novel means for supplying the necessary compressed air to shed retainer members 16 associated with each shed retainer station S in order to facilitate transportation of an inserted weft thread from chamber 12 across the width of each shed retaining station 16.

As will be appreciated by one skilled in the art, four additional weft threads can be supplied to weft thread supply chamber 12 in order to obtain a two color weft pattern since weft threads W1–W4 shown in the drawings will only provide a one color weft pattern. In order to achieve four color weft thread patterns, two weft thread supply chambers 12 (not shown) could be utilized and stationarily positioned adjacent the horizontal pathway of shed retainer stations S as the weave pattern may dictate. The small change in angle necessitated by positioning two weft thread supply chambers 12 in substantially the same position as one chamber 12 shown in FIGS. 2 and 3 of the drawings would not interfere with the efficacy of weft thread insertion.

Novel Air Jet Relay System

Next, applicant's novel air jet relay system used in conjunction with the previously described novel weft insertion mechanism associated with weft thread supply chamber 12 will be described in specific detail. As will be appreciated by those skilled in the art, applicant's previously described air supply shown in FIGS. 31–33 of U.S. Pat. No. 4,425,946 does not specifically provide any way of supplying compressed air to the supply hose of the vertically movable valve, and it would undoubtably require a very complex maze of tubing or the like to do so. In order to overcome the complexity and operating inefficiencies of such an air supply system, applicant has now discovered a novel and reliable manner in which to provide compressed air to main nozzle 14, one or more relay nozzles 22 and tensioning nozzle 20 of each bore or tube defined by shed retaining members 16 mounted on each shed retaining station S. Applicant's novel air nozzle relay system provides a simple and reliable means for providing compressed air to main nozzles 14, relay nozzles 22 and tensioning nozzle 20 associated with each shed retaining station S in a continuous manner as it moves forwardly toward the fell of the fabric being formed. Since the weft thread entering main nozzle 14 of a shed retainer formed by shed retaining members 16 is already moving at the velocity imparted by fixed nozzles 12B and 12C of weft thread supply chamber 12, the additional velocity achieved by main nozzle 14 and relay nozzles 22 in the shed retainer results in increased average velocity of the weft thread and higher productivity in comparison to prior art weft thread insertion systems.

Referring now particularly to FIGS. 2–6 of the drawings, applicant's novel air jet relay system including its fluidly communicating air supply will now be described in specific detail.

As specified hereinbefore, applicant contemplates that each shed retainer defined by shed retainer members 16 and carried by its respective shed retaining station S will have fixed main nozzle 14, one or more relay nozzles 22 and fixed tensioning nozzle 20 associated with the shed retainer to facilitate insertion of a weft thread inserted into main nozzle 14 by weft thread supply chamber 12. As particularly well shown in FIGS. 4 and 5, fixed main nozzle 14 and tensioning nozzle 20 as well as pivotably mounted relay nozzles 22 defined within the stem of selected shed retaining members 16 all include air passageways extending downwardly through a corresponding shed retainer station S and defining an aperture in the bottom surface of station S. The apertures 14A, 22A and 20A, respectively, are all configured so as to fluidly communicate with a corresponding air supply source or valve assembly positioned beneath the forward pathway of movement of shed retainer stations S. For example, in FIG. 5, air supply sources or valve assemblies AS1–AS4 can be seen to correspond with main nozzle 14, to two relay nozzles 22 and weft thread tensioning nozzle 20, respectively.

Figure 4:
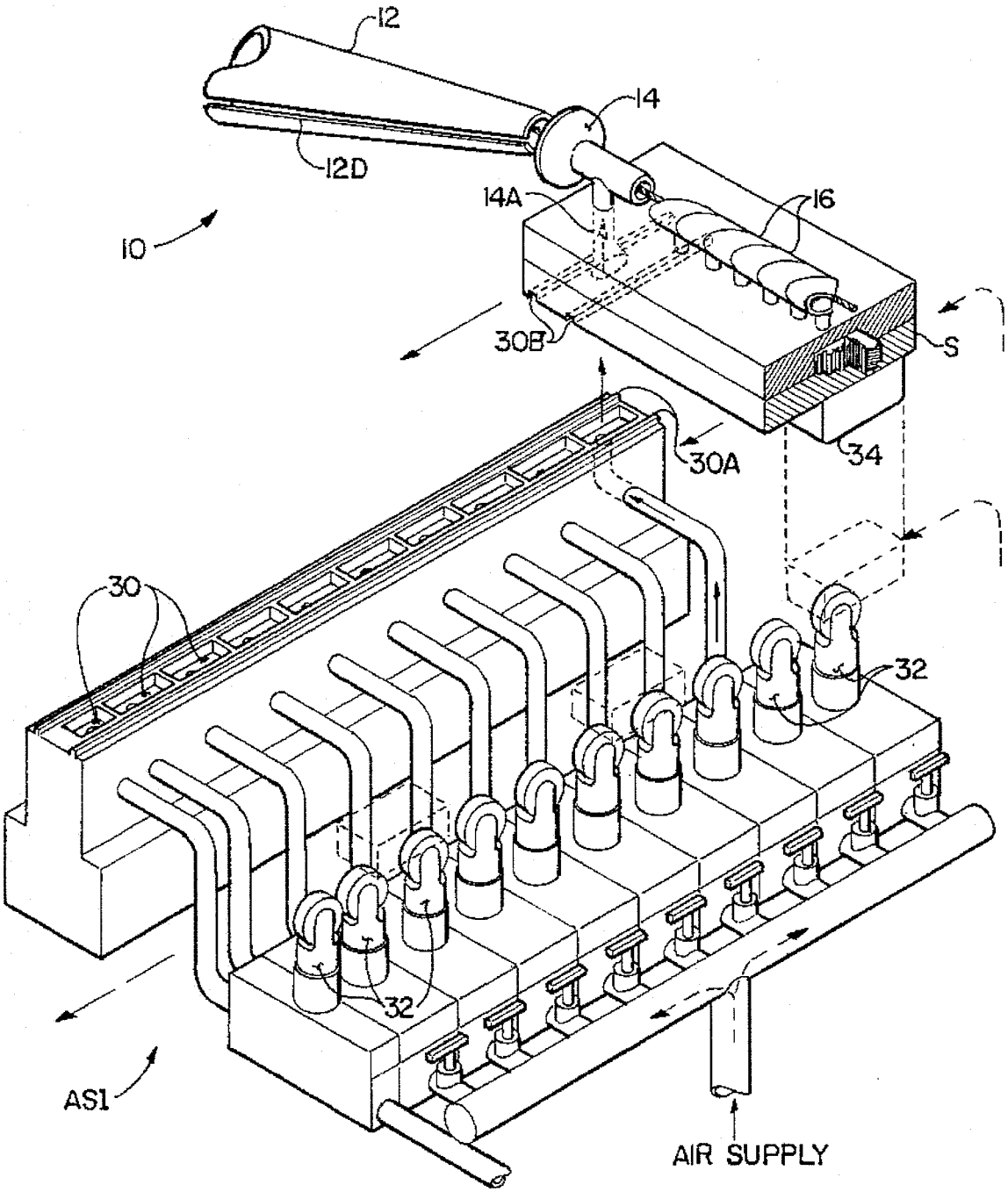
FIG. 4 is a perspective view of the air supply source for providing compressed air to the main nozzle of each shed retaining means.

It will be appreciated that each of four air supply sources or valve assemblies AS1–AS4 are substantially identical and their construction can be best appreciated by referring to the detailed depiction of air supply source AS1 in FIG. 4 that is utilized to supply compressed air to main nozzles 14 associated with shed retaining stations S as they move forwardly from the insertion station of weft thread W1–W4 toward the fell of fabric F where the weft thread is released by shed retaining members 16 so that it may be beat up into the fell of fabric F in a conventional manner.

Referring now to FIG. 4 and air supply source AS1 shown therein, it will be appreciated that air supply source AS1 consists of a plurality of air chambers 30 (for example 10 chambers as shown in FIG. 4) which are arranged in a linear and sequential orientation extending parallel to the pathway of movement of shed retainer stations S. Air chambers 30 are each supplied with compressed air by a corresponding plurality of mechanical air valves 32 which are each fluidly connected to an air chamber 30. A cam block 34 is mounted on the bottom of each shed retainer station S so as to sequentially activate valves 32 during forward movement of shed retainer station S over valves 32 and associated air chambers 30. In this fashion, cam block 34 will act to depress and open an air valve 32 when its associated shed retainer station S is located thereover so as to permit air flow to corresponding air chamber 30 and bottom aperture 14A of main nozzle 14 located thereover.

Figure 5:
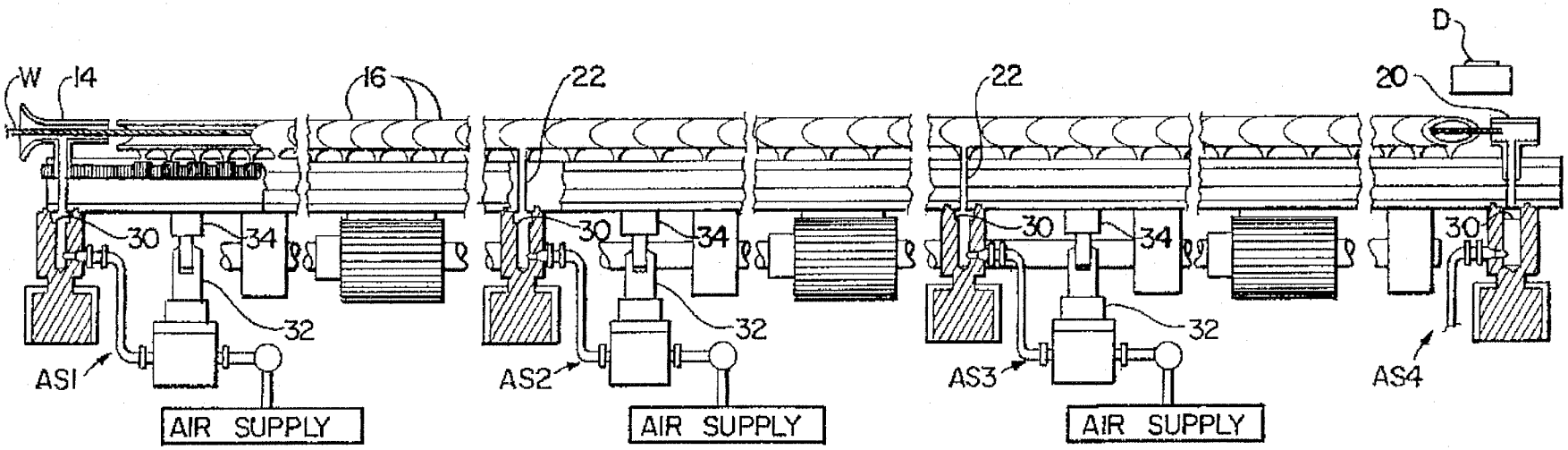
FIG. 5 is a transverse vertical cross-sectional view showing the air supply source for providing compressed air to the main air nozzle, two relay air nozzles and the weft tensioning air nozzle of a shed retaining means.
Figure 8:
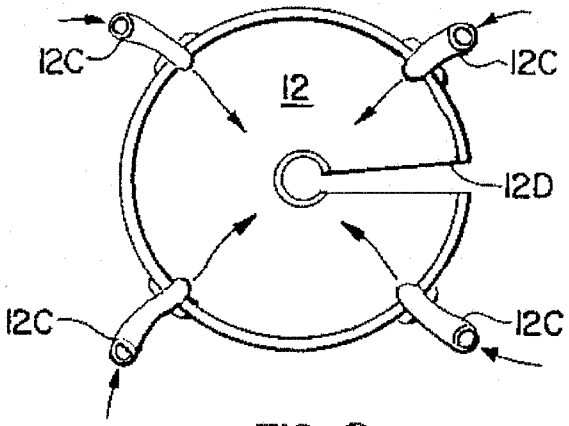
FIG. 8 is a view taken along lines 8—8 of FIG. 2 of the weft thread supply chamber utilized by the present invention.

As can be appreciated with reference to the drawings, particularly FIGS. 4 and 5, air supply source AS1 will continuously provide air to aperture 14A of main nozzle 14 from air chambers 30 as associated shed retainer station S traverses along the length of air supply source AS1 from its weft thread insertion location toward the fell of the fabric F being woven. Shed retainer station S is maintained in fluid communication with stationary air source supply AS1 and particularly air chambers 30 defined along the length of the top portion thereof by two parallel and spaced-apart tracks 30A extending along the length of ten air chambers 30 and which are adapted to be slidably received within two parallel and corresponding slots 30B provided in the bottom surface of shed retainer station S.

Although FIG. 4 only depicts air supply source AS1 providing compressed air to main nozzles 14 of each shed retainer station S as it continuously moves from its weft thread insertion station towards the fell of the fabric F being woven, simultaneously therewith air supply sources AS2 and AS3 provide continuous air supply to two or more relay nozzles 22, respectively, and fourth air supply source AS4 provides continuous air supply to weft thread tensioning nozzle 20 (as can be best seen in FIG. 5 of the drawings). The novelty of applicant's air jet relay system utilizing air supply sources AS1–AS4 resides in large measure in the ability to provide continuous air supply to nozzles 14, 22 and 20 of each shed retainer station 8 from stationarily mounted air supply means AS1–AS4. The simplicity of the air jet relay system and related air supply source assembly and its ability to provide continuous fluid communication therebetween during the continuous forward movement of shed retainer stations S allows for reliable high speed operation of the multi-shed warp-wave loom described in applicant's earlier U.S. Pat. No. 4,425,946.

Figure 4A:
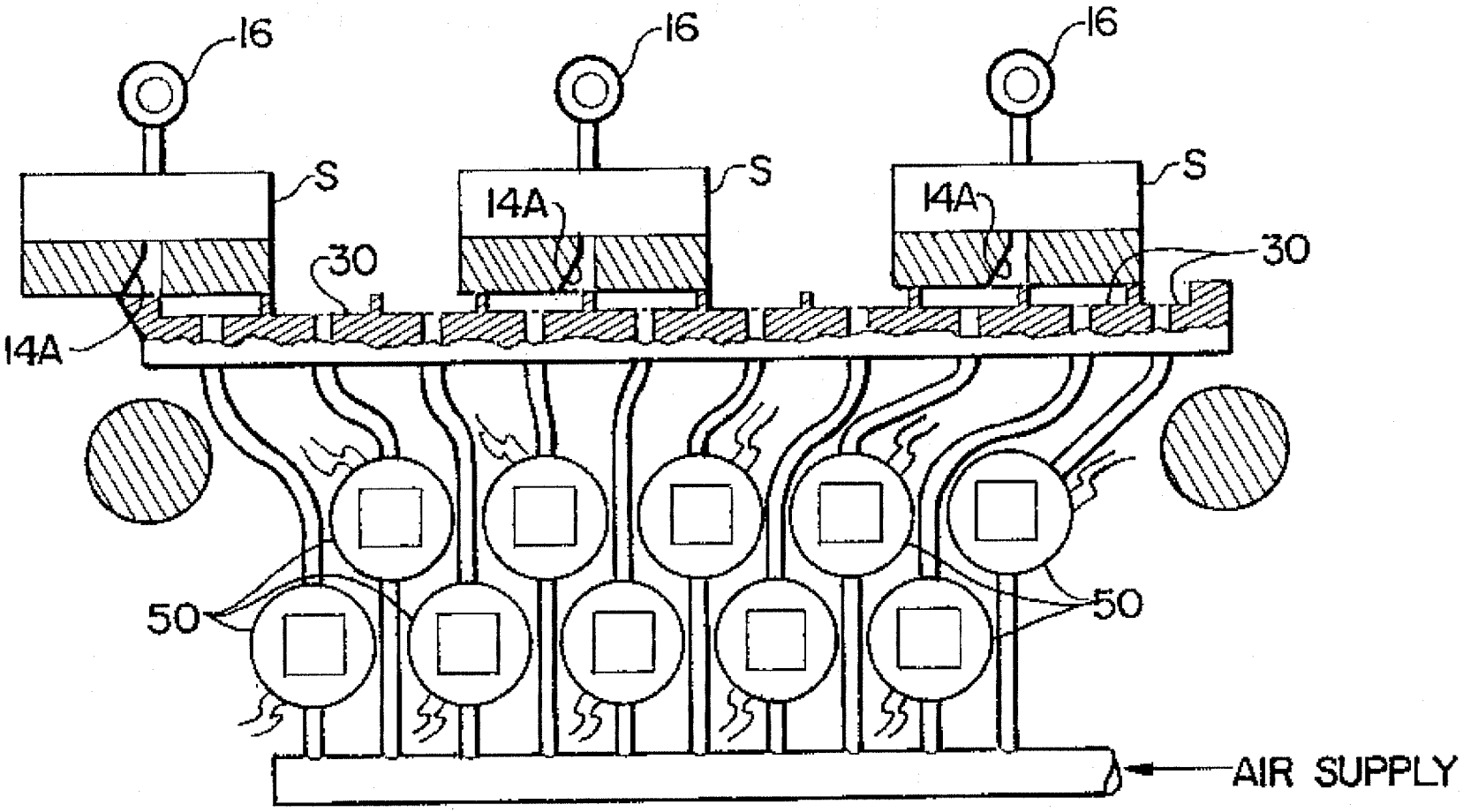
FIG. 4A is a schematic side elevational view of an alternative air supply source for providing compressed air to the main air nozzles, relay air nozzles and weft tensioning air nozzles of each shed retaining means utilizing solenoid air valves.

FIG. 4A shows a schematic diagram of an alternative embodiment of air supply sources AS1–AS4 wherein solenoids 50 (for example, utilizing 10 solenoids corresponding to the 10 mechanical valves 32 shown in FIG. 4 to provide air to nozzle 14) are activated by a timed controller (not shown) in lieu of mechanical valves 32 to provide sequential air supply to air chambers 30 of air supply source AS1. The use of mechanical valves 32 or electronic solenoids 50 as valves to control air supply to air chambers 30 by air supply sources AS1–AS4 is a matter of design choice. Moreover, applicant contemplates that additional valve systems could be substituted for either mechanical valves 32 or electronic solenoids 50 and that such additional valve controls would be within the scope of the present invention.

Figure 6:
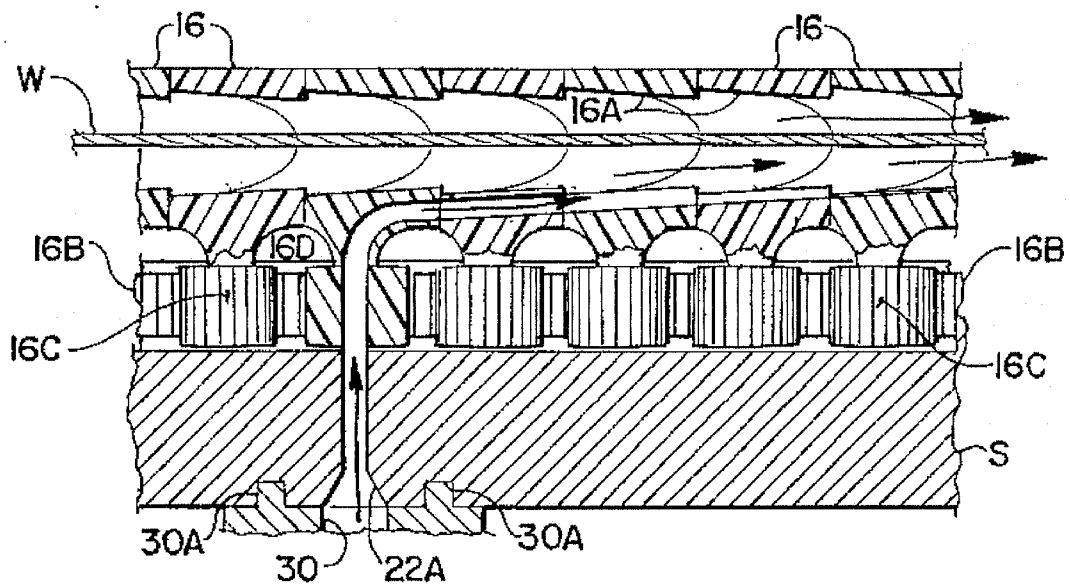
FIG. 6 is a transverse vertical cross-sectional view of a plurality of shed retaining members forming a substantially closed tube to provide a pathway for insertion of a weft yarn therethrough.

Finally, with reference to FIG. 6 of the drawings, applicant notes that shed retainer station S carries pivotably mounted shed retainer members 16 thereon somewhat similarly to the disclosure of applicant's own U.S. Pat. No. 4,425,946. Shed retainer members 16 are caused to open and close so as to form weft thread insertion bore 16A by means of slidably activated rack 16B and matingly engaged pinion gears 16C which are each connected to the stem of a corresponding shed retainer member 16. As noted previously, fluid passageway 16D is provided through the stem of one or more selected shed retainer members which serves as a relay nozzle 22 described hereinbefore. The passageway 16D in the stem of shed retainer member 16 extends through the base of shed retainer station S so as to define aforementioned aperture 22A at the bottom of shed retainer station S that fluidly sequentially communicates with air chambers 30 of its respective air supply source (e.g., AS2 or AS3 shown in FIG. 5).

It will be understood that various details of the invention may be changed without departing from the scope of the invention. Furthermore, the foregoing description is for the purpose of illustration only, and not for the purpose of limitation—the invention being defined by the claims.

What is claimed is:

1. In a method of weaving including the steps of forming sheds of warp threads successively at a first location on a loom, continuously moving said sheds away from said first location and toward a second location spaced a distance from said first location such that said sheds move in a direction generally parallel to said warp threads, retaining a plurality of said sheds during the continuous movement of said sheds from said first location towards said second location, and inserting weft threads into said retained sheds during the continuous movement of said retained sheds from said first location towards said second location such that each of said retained sheds has a weft thread inserted thereinto; the improvement comprising the steps of:

(a) retaining said sheds by inserting shed retaining means into each of said sheds, using said shed retaining means to form a plurality of continuous substantially closed tubes, each tube being formed in a corresponding one of said retained sheds;

(b) providing a weft thread supply chamber with a plurality of weft threads therein, said weft thread supply chamber being stationarily mounted adjacent the pathway of movement of said shed retaining means from said first location to said second location;

(c) pneumatically inserting said weft threads into said tubes formed by said shed retaining means as said tubes pass said weft thread supply chamber and each weft thread being substantially constrained within a corresponding one of said tubes by an associated shed retaining means until its respective retained shed is released; and (d) causing said weft threads to traverse said tubes by providing an air flow therein in the direction of insertion of said weft threads with an air supply means stationarily mounted beneath said shed retaining means and fluidly communicating with said tubes during the continuous movement of said tubes from said first location towards said second location such that each of said weft threads inserted within a corresponding one of said tubes by said weft supply chamber is caused to traverse said tube before its respective retained shed is released;

whereby a predetermined number of said weft threads can be inserted substantially simultaneously into a corresponding number of said continuously moving retained sheds.

2. The improved method of claim 1 comprising providing a plurality of weft threads to said weft thread supply chamber wherein each weft thread therein is provided with at least one compressed air source for propelling said weft thread from said supply chamber and inserting said weft thread into a corresponding one of said plurality of tubes.

3. The improved method of claim 1 wherein providing said air flow within said tubes includes providing an air flow to each of said tubes via a main air nozzle positioned adjacent an end of said tube proximal to said weft thread supply chamber; a weft tensioning air nozzle positioned adjacent a second end of said tube distal to said weft thread supply chamber; and at least one relay air nozzle positioned along the length of said tube.

4. The improved method of claim 3 further including continuously providing an air supply from said air supply means to said main air nozzle, weft tensioning air nozzle and relay air nozzle corresponding to each of said tubes as each of said tubes continuously moves from said first location towards said second location, and each of said shed retaining means serving to actuate said air supply means fixedly mounted therebeneath during said continuous movement from said first location towards said second location.

5. The improved method of claim 3 further including continuously providing an air supply from said air supply means to said main air nozzle, weft tensioning air nozzle and relay air nozzle corresponding to each of said tubes as each of said tubes continuously moves from said first location towards said second location, and said air supply means fixedly mounted beneath said shed retaining means being selectively actuated during movement of each of said shed retaining means thereover during said continuous movement from said first location towards said second location.

6. In a weaving apparatus including shed forming means for forming sheds of warp threads successively at a first location on a loom, shed moving means for continuously moving said sheds away from said first location and toward a second location spaced a distance from said first location such that said sheds move in a direction generally parallel to said warp threads, shed retaining means for retaining a plurality of said sheds during the continuous movement of said sheds from said first location toward said second location, and inserting means for inserting weft threads into said retained sheds during the continuous movement of said retained sheds from said first location toward said second location such that each of said retained sheds has a weft thread inserted thereinto; the improvement wherein:

(a) said shed retaining means retains said sheds by inserting a plurality of shed-retaining members into each of said sheds such that said plurality of shed-retaining members form a plurality of substantially closed tubes wherein each tube is formed in a corresponding one of said retained sheds; and (b) said inserting means comprises (i) a weft thread supply chamber with a plurality of weft threads therein being stationarily mounted adjacent the pathway of movement of said shed retaining means from said first location to said second location and adapted to pneumatically insert said weft threads into said tubes formed by said shed retaining means as said tubes pass thereby such that each weft thread is substantially constrained within a corresponding one of said tubes by associated shed retaining members until its respective retained shed is released, and (ii) air supply means stationarily mounted beneath said shed retaining means and adapted to fluidly communicate with each of said tubes and to provide an air flow in the weft thread insertion direction during the continuous movement of said tubes from said first location toward said second location such that each of said weft threads inserted within a corresponding one of said tubes by said weft thread supply chamber is caused to traverse said tube before its respective retained shed is released;

whereby a predetermined number of weft threads can be inserted substantially simultaneously into a corresponding number of continuously moving retained sheds.

7. The improved apparatus of claim 6 wherein said weft thread supply chamber comprises a funnel-shaped housing having a plurality of weft threads supplied thereto and wherein each weft thread is provided with at least one air jet for propelling said weft thread from said weft thread supply chamber and into a selected one of said plurality of tubes.

8. The improved apparatus of claim 7 wherein a weft strand take-up mechanism is provided for each weft thread prior to entry into said weft thread supply chamber.

9. The improved apparatus of claim 6 further including for each of said tubes a main air nozzle positioned adjacent an end of said tube proximal to said weft thread supply chamber, a weft tensioning air nozzle positioned adjacent a second end of said tube distal to said weft thread supply chamber, and at least one relay air nozzle positioned along the length of said tube that fluidly communicate with said air supply means during the continuous movement of said tube from said first location towards said second location.

10. The improved apparatus of claim 9 wherein said air supply means extends from said first location to said second location and comprises sequentially activatable air valve means operatively associated with said main air nozzle, weft tensioning air nozzle and relay air nozzle corresponding with each of said tubes.

11. The improved apparatus of claim 10 wherein said air valve means comprises a plurality of mechanical valves that are activated by said shed retaining means as each of said shed retaining means pass thereover during their continuous movement from said first location to said second location.

12. The improved apparatus of claim 10 wherein said air valve means comprises a plurality of solenoid valves electrically connected to control means for selectively activating said valves in fluid communication with said each of said shed retaining means during its continuous movement from said first location to said second location.

* * * * *